US008002048B2

(12) United States Patent
Saehn et al.

(10) Patent No.: US 8,002,048 B2
(45) Date of Patent: Aug. 23, 2011

(54) DRILLING IMPLEMENT AND METHOD FOR OPERATING A DRILLING IMPLEMENT

(75) Inventors: Matthias Saehn, Aigelsbach (DE); Karl Johannes Krollmann, Augsburg (DE); Matthias Jais, Aresing (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 226 days.

(21) Appl. No.: 12/230,709

(22) Filed: Sep. 3, 2008

(65) Prior Publication Data

US 2009/0071674 A1 Mar. 19, 2009

(30) Foreign Application Priority Data

Sep. 19, 2007 (EP) ..... 07018414

(51) Int. Cl.
*E21B 3/02* (2006.01)

(52) U.S. Cl. ..... 173/184; 173/152; 173/216; 175/170; 175/220

(58) Field of Classification Search ..... 173/4, 19, 173/184, 216, 89, 176, 178, 147, 152, 189, 173/194; 175/52, 85, 135, 162, 220
See application file for complete search history.

(56) References Cited

U.S. PATENT DOCUMENTS

| | | | | |
|---|---|---|---|---|
| 3,730,285 | A * | 5/1973 | Anderson et al. | 175/220 |
| 3,766,991 | A * | 10/1973 | Brown | 173/20 |
| 4,232,752 | A * | 11/1980 | Hauk et al. | 175/135 |
| 4,258,796 | A * | 3/1981 | Horning et al. | 175/52 |
| 4,877,091 | A * | 10/1989 | Howell, Jr. | 173/89 |
| 4,984,641 | A * | 1/1991 | Pryor | 175/170 |
| 5,281,775 | A * | 1/1994 | Gremillion | 181/116 |
| 6,471,445 | B2 * | 10/2002 | Stansfield | 405/232 |
| 6,668,684 | B2 * | 12/2003 | Allen et al. | 81/57.15 |
| 6,725,949 | B2 * | 4/2004 | Seneviratne | 175/85 |
| 7,093,679 | B1 * | 8/2006 | Watson | 175/170 |
| 7,188,686 | B2 * | 3/2007 | Folk et al. | 175/162 |

FOREIGN PATENT DOCUMENTS

| | | |
|---|---|---|
| DE | 19509379 A1 | 9/1996 |
| DE | 19721059 C1 | 11/1998 |
| JP | 07-076984 | 3/1995 |
| JP | 8-226372 | 9/1996 |
| JP | 2002-97882 | 4/2002 |

* cited by examiner

*Primary Examiner* — Scott A. Smith
(74) *Attorney, Agent, or Firm* — Jacobson Holman PLLC

(57) ABSTRACT

The invention relates to a drilling implement with a derrick, a drill drive for driving a drill rod guided on the derrick and a gear, which is placed between the drill drive and drill rod for transmission purposes. According to the invention, for inverting the gear ratio, the gear is placed in disengageable and reversible manner on the drill drive.

11 Claims, 6 Drawing Sheets

DRILLING IMPLEMENT AND METHOD FOR OPERATING A DRILLING IMPLEMENT

BACKGROUND OF THE INVENTION

1. Field of the Invention

The invention relates to a drilling implement with a derrick or mast, a drill drive guided on said derrick or mast for driving a drill rod and a gearing placed between the drill drive and drill rod for transmission purposes.

2. Description of related art including information disclosed under 37 CFR §§1.97 and 1.98

Frequently with such a drilling implement different drilling methods are to be carried out or during a complex drilling procedure different demands are made on the rotation speed and/or torque of the drill or drill rod respectively.

One possibility for meeting these different demands consists of using different drilling implements. However, in the case of complex drilling procedures this involves a considerable expenditure, because e.g. successive drilling steps have to be carried out with different drilling implements.

Thus, e.g. with known drilling implements the rotation speed of a drill drive can be regulated or controlled. Thus, even with a single drilling implement it is possible to implement different rotation speeds and torques on the drill rod or drill respectively. However, this suffers from the disadvantage of the relatively high constructional expenditure for the motor and the complex control. Thus, such a drilling implement is associated with comparatively high manufacturing and maintenance costs. A drilling implement with a regulatable drill drive is described in JP 8-226372. JP 07-076984 describes the use of hydraulic motors having two speeds and an additional change in the hydraulic drive of the motors from series to parallel connection.

As an alternative drilling implements with shiftable gears have been proposed. Said gears generally have a relatively complex construction. A drilling implement with an adaptable gear ratio between the drill drive and drill rod is e.g. known from JP 2002-97882. In order to provide different rotation speeds and torques on the drill rod said specification proposes the provision of two different gear ratio stages, which can be used as desired.

The known drilling implements allowing an adaptation of the rotation speed of the drill rod either have a complex drive or a complex gear.

BRIEF SUMMARY OF THE INVENTION

Against this background the object of the invention is to provide a drilling implement and a drilling method, which with a very simple and low-maintenance construction of the drilling implement, permit an easy adaptation of the rotation speed of a drill rod.

According to the invention this object is achieved in that the gearing can be disengaged for inverting the gear ratio and is placed in reversible manner on the drill drive.

For adapting the rotation speed of the drill rod and consequently the drill connected thereto, the gearing is disengaged from the drill drive, reversed and connected to the drill drive again in the reversed state.

Thus, a gearing input connected in a first state to the drill drive is used in a second, reverse state for connection to the drill rod. Simultaneously, a gear gearing output provided for connection to the drill rod in a first state, is connected to the drill drive in the second, reversed state.

For this purpose the gearing input and gearing output are designed in such a way that they are in each case connectable both to the drill drive and the drill rod.

Thus, in simple manner the drilling implement according to the invention is able to provide two different transmission ratios and consequently drill rod rotation speeds.

The gearing can have a relatively simple construction. In particular, the gearing can be a non-shiftable gearing, which is fundamentally known from drilling implements. There is also no need for a drill drive adapted to the drilling procedure and no modification of a hydraulic coupling. The drill drive can be a motor supplying only a single rotation speed, i.e. it need not be controllable or regulatable respectively with respect to rotation speed.

A particularly preferred embodiment of the inventive drilling implement is characterized in that the gearing has a drive unit with a first connecting device for connection to the drill drive and a driven unit with a second connecting device for connecting to the drill rod and that the first connecting device and second connecting device have a substantially identical construction.

The drive unit can in particular be a shaft, which is placed at a gearing input and can be referred to as the driving shaft. For connection to the drill drive, particularly an output shaft of the drill drive, which can also be referred to as the motor output shaft, a first connecting device is provided on the drive unit. Said connecting device can be connected positively, non-positively or in self-substance manner to the drill drive or motor output shaft and to the gearing respectively. It is particularly preferred that the connection between the drill drive and gearing can be made by positive engagement, e.g. via a toothed connection or a key and slot connection.

At a gearing output, the gearing has a driven unit, which can also be constructed as a shaft and referred to as the driven shaft. The driven unit can be connected to the drill rod by means of a second connecting device.

It is fundamentally possible to have a different construction of the first and second connecting devices and e.g. following the reversal of the gearing for connection to the drill drive or drill rod respectively, are replaced or provided with in each case adapted adapters. However, it is particularly preferable for the first and second connecting devices to have a substantially identical construction. As a result in particularly simple manner, in the reversed state the gearing can be again connected to the drill drive and drill rod. The driven unit is connected to the drill drive and the drive unit to the drill rod.

According to an embodiment of the invention, the gearing has an annular construction. This is understood to mean in particular that both the drive unit and driven unit are constructed as at least partly hollow shafts. The annular gearing offers the advantage that the motor output shaft and the drill rod can be particularly easily connected to the gearing, in that they are in each case introduced into the hollow shafts. By suitable connecting devices, particularly disengageable couplings, such as are known basically from the prior art, the nested shafts are connected to rotate.

A particularly preferred embodiment of the invention involves that the connecting device for connecting the gearing to the drill drive can be a flange mount. As a result of the flange mounting connection, it is ensured that the gearing can be disengaged from the drill drive without significant expenditure. To be able to also flange mount the gearing to the drill drive in the reversed state, it is particularly preferred for substantially identical flanges to be provided at the gearing input and gearing output. The flange located in each case on the side of the drill rod can have no function when the gearing is installed.

For compensating for an angular displacement between the drill drive and gearing, it is particularly preferable for the gearing to be connectable to the drill drive via a universal joint. As a result of the universal joint placed between the drill drive and the gearing, an angle between the longitudinal axes of the motor output shaft and the drive unit, particularly the drive shaft, can be bridged.

According to a preferred development of the invention, the drill drive is placed on a first carriage guided on the mast. For the axial feed or advance of the drill and drill rod, the drill drive and gearing are axially displaced on the mast, so that there is fundamentally no need for telescopable rods for axial feed purposes.

In a particularly preferred embodiment of the invention the gearing is placed on a second carriage guided on the mast. This arrangement permits a particularly convenient reversal of the gearing. For this purpose it is proposed the following course of action. Initially the connection between drill drive and gearing is disengaged and the drill rod is removed from the gearing. The second carriage is then axially fixed on the mast and the first carriage with the drill drive is moved axially away from the second carriage. The gearing is then reversed. The first carriage with the drill drive is then moved axially again towards the gearing for connection to the gearing in the reversed state.

It is particularly advantageous if the gearing is placed in rotary manner on the second carriage in order to allow an easy reversal of the gearing without releasing it from the second carriage. Thus, the weight of the gearing can also be carried by the second carriage during reversal and makes it possible for an operator to perform a gear ratio adaptation without significant force expenditure. It is also advantageous in this connection for the second carriage to have a brake for axial fixing to the mast.

A further development of the invention is that at least one universal joint is provided between the gearing and drill rod. The universal joint is particularly advantageous if the drill rod is guided on the mast by means of its own rod guide. The universal joint permits a compensation of an angular displacement between the longitudinal axes of the driven unit of the gearing and the drill rod.

It is particularly preferable for the drill drive to be guided on a first carriage, the gearing on a second carriage and the drill rod on a rod guide on the mast. As a result of the two carriages and the rod guide the aforementioned method for reversing the gearing can be implemented with particular ease. Both the drill drive and the drill rod can be held on the mast during the reversal of the gearing. Advantageously in this embodiment two universal joints are provided, which are located between the drill drive and gearing or between the gearing and drill rod respectively.

According to the invention it is advantageous for the gearing to have a gearbox with two substantially identically constructed flange connections. As a result in the starting state and in a reversed state the gearing can be connected to the drill drive without an adapter.

The inventive method for operating the drilling implement is characterized in that the gearing is disengaged from the drill drive for inverting the gear ratio, is reversed and in the reversed state is reconnected to the drill drive. This method makes it possible to execute a change of the gear ratio, e.g. for adapting to a different drilling procedure, in a particularly time-saving and inexpensive manner. It is possible to avoid a complicated conversion of the drilling implement or even a replacement of the drilling implement by a different drilling implement.

BRIEF DESCRIPTION OF THE SEVERAL VIEWS OF THE DRAWINGS

The invention is exemplary further described hereinafter relative to the attached drawings, wherein show.

DETAILED DESCRIPTION OF THE INVENTION

Figure 1:
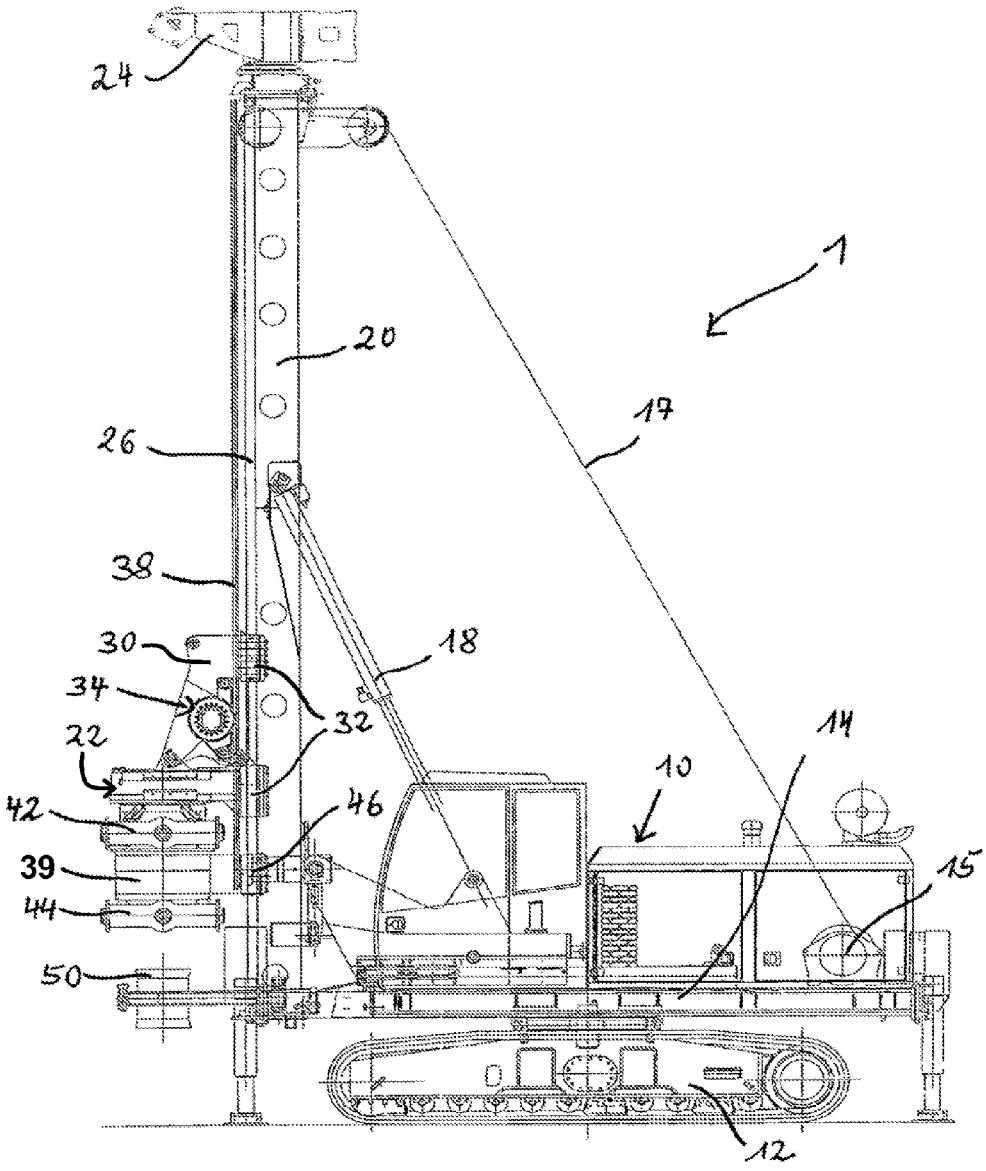
FIG. 1 A drilling implement with a drill drive and a gearbox in which is received a gearing with a transmission to high speed.

FIG. 1 shows an inventive drilling implement 1 with a mast or derrick 20, a drill drive 22 and a gearing 40. Drilling implement 1 has a vehicle 10 comprising a lower chassis 12 and an upper chassis 14 articulated in rotary manner thereto. The mast 20 is pivotably placed on the upper chassis 14. By means of a pivoting cylinder 18, the mast 20 can be pivoted from a substantially vertical operating position into a substantially horizontal transportation position. In a rear region of the upper chassis 14 is placed a winch 15, which receives a cable 17, which leads to a guide pulley located in the upper region of the mast. The mast 20 also has a mast head 24. In its operating position the mast 20 is placed in front of a front region of the vehicle 10. On a front side of the mast, i.e. a side facing away from the vehicle 10, the mast 20 has a guide device 26 on which a first slide 30 can be guided along said mast 20. The guide device 26 has two guide rails, which are positioned laterally in a front region of the mast. The first carriage 30 has four guide shoes 32 and in each case two guide shoes 32 can be slidingly engaged with a guide rail. On the first carriage 30 is provided a feed drive 34, which serves to move the first carriage 30 along the mast 20. For this purpose there are placed two fixed chains 38 on mast 20. The feed drive 34 is connected to rotate with two driving pinions, which are so connected to the fixed chains 38 that on operating the feed drive 34 said feed drive 34, together with the first carriage 30, is moved along the fixed chains 38.

The first carriage 30 also has a drill drive 22 provided for the rotary driving of a drill rod. Thus, the drill drive 22 can also be referred to as a rotary drive. The drill rod can e.g. be a kelly bar or also a drilling tube used for supporting the drill or bore hole during so-called kelly drilling. Below the drill drive 22, a gearing 40, which raises the speed and lowers the torque is mounted to a first universal joint 42 by a flange 41. In this embodiment the drilling implement 1 is e.g. suitable for displacement or CSV drilling operations which require a high speed.

Gearing 40 is placed on its own, second carriage 46, which is also guidable along the mast 20. Below the gearing 40 is flange mounted a second universal joint 44 provided for receiving the drill rod.

According to the invention, gearing 40 is placed in disengageable and reversible manner on the drill drive 22 for inverting the gear ratio. For guiding and/or locking the drill rod a rod guide 50 is provided below the gear 40 and the second universal joint 44. Said rod guide is fixed to mast 20.

Figure 2:
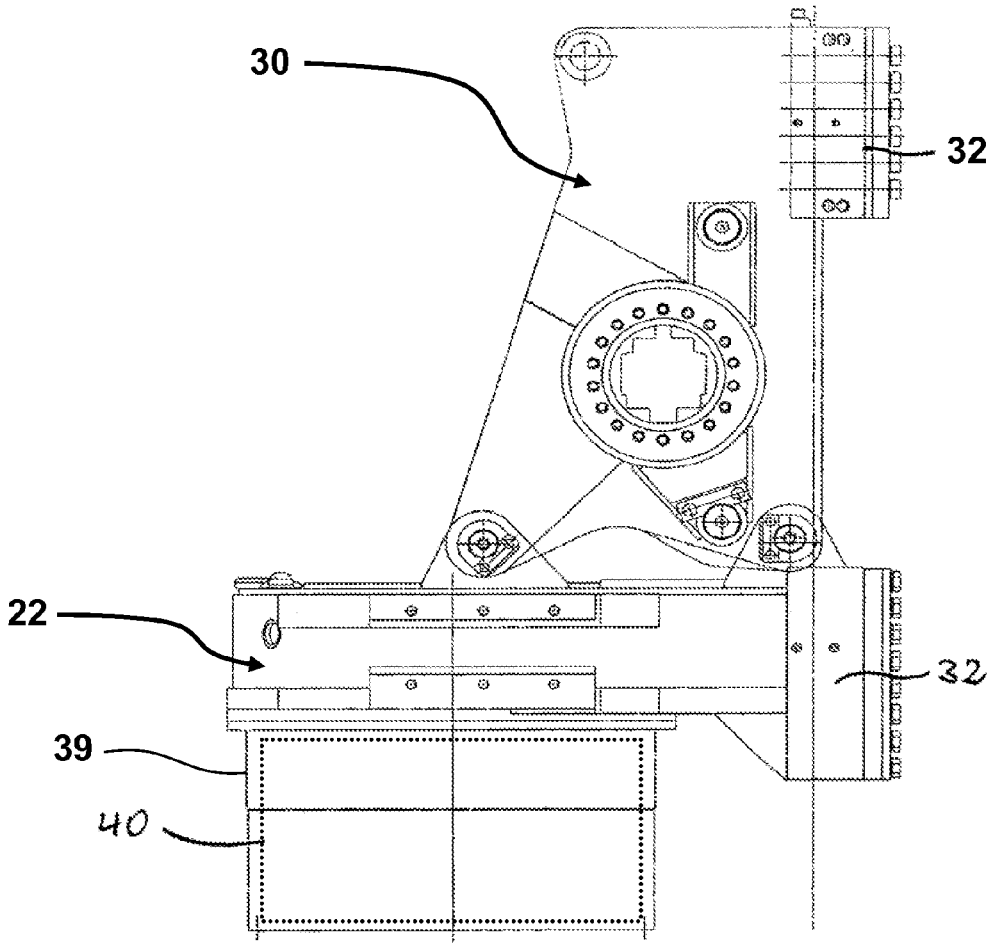
FIG. 2 An embodiment of a drill drive with directly flange mounted gearing for torque increase purposes.
Figure 6:
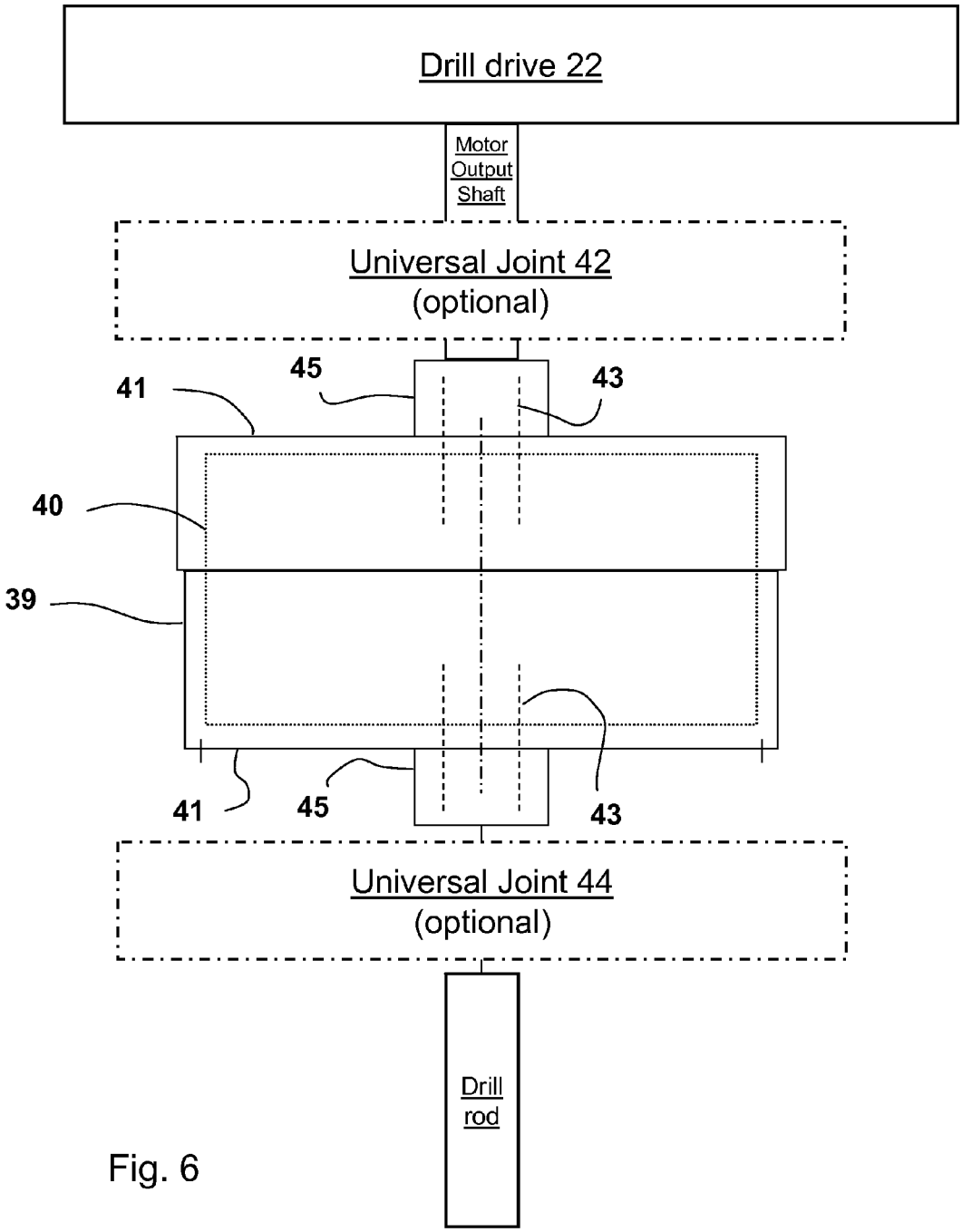
FIG. 6 A schematic illustration of the gearbox shown in FIG. 1, with the gearing, flange connections, drive unit (hollow shaft), driven unit (hollow shaft), and connecting devices, and their relationship to the drill drive and the drill rod.

FIG. 2 shows an embodiment of an inventive gearing 40. The gearing 40 is so positioned in the shown view that it brings about a transmission to a low speed and therefore causes a torque increase. A high torque is e.g. required for kelly drilling. The gearing 40 is connected directly, without a universal joint, to the drill drive 22. For this purpose a gearbox 39, which receives the gearing 40, is flange mounted to the first carriage 30. Drill drive 22 and gearing 40 are rotatably mutually engaged with each other. For this purpose a motor output shaft of drill drive 22 is connected via a connecting device in the form of a coupling 45 to a drive unit 43 of gearing 40 constructed as a hollow shaft, as shown in FIG. 6. At the end of the gearing 40 opposite to the drill drive 22, a drill rod can be so connected to the gearing 40 that a torque is transmitted thereto.

Figure 3:
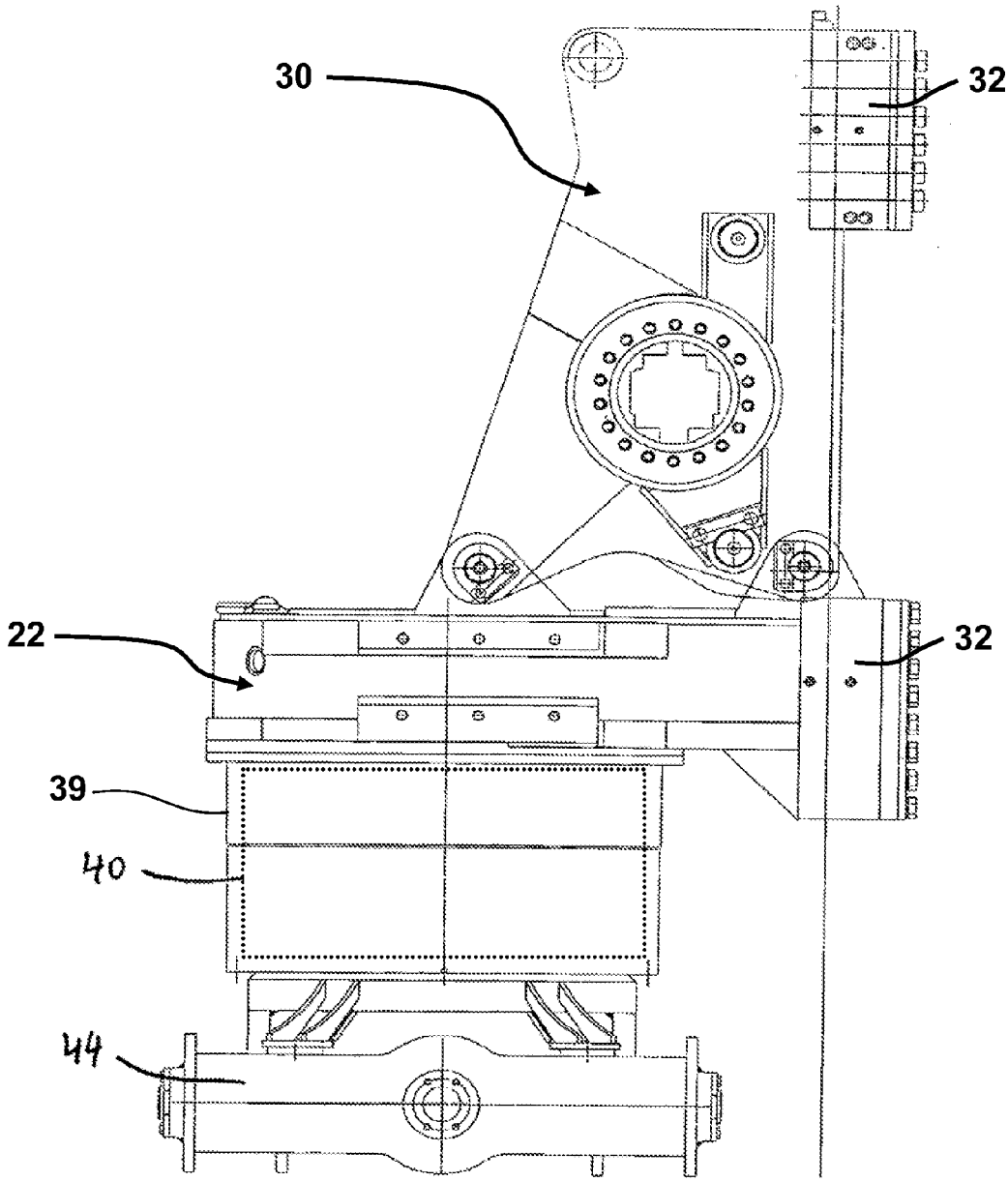
FIG. 3 The gear of FIG. 2, additionally with a universal joint at the gearing output.

FIG. 3 shows the gearing 40 with drill drive 22 shown in FIG. 2, additionally with a second universal joint 44 placed beneath gearing 40. The second universal joint 44 is provided for receiving a drill rod.

Figure 4:
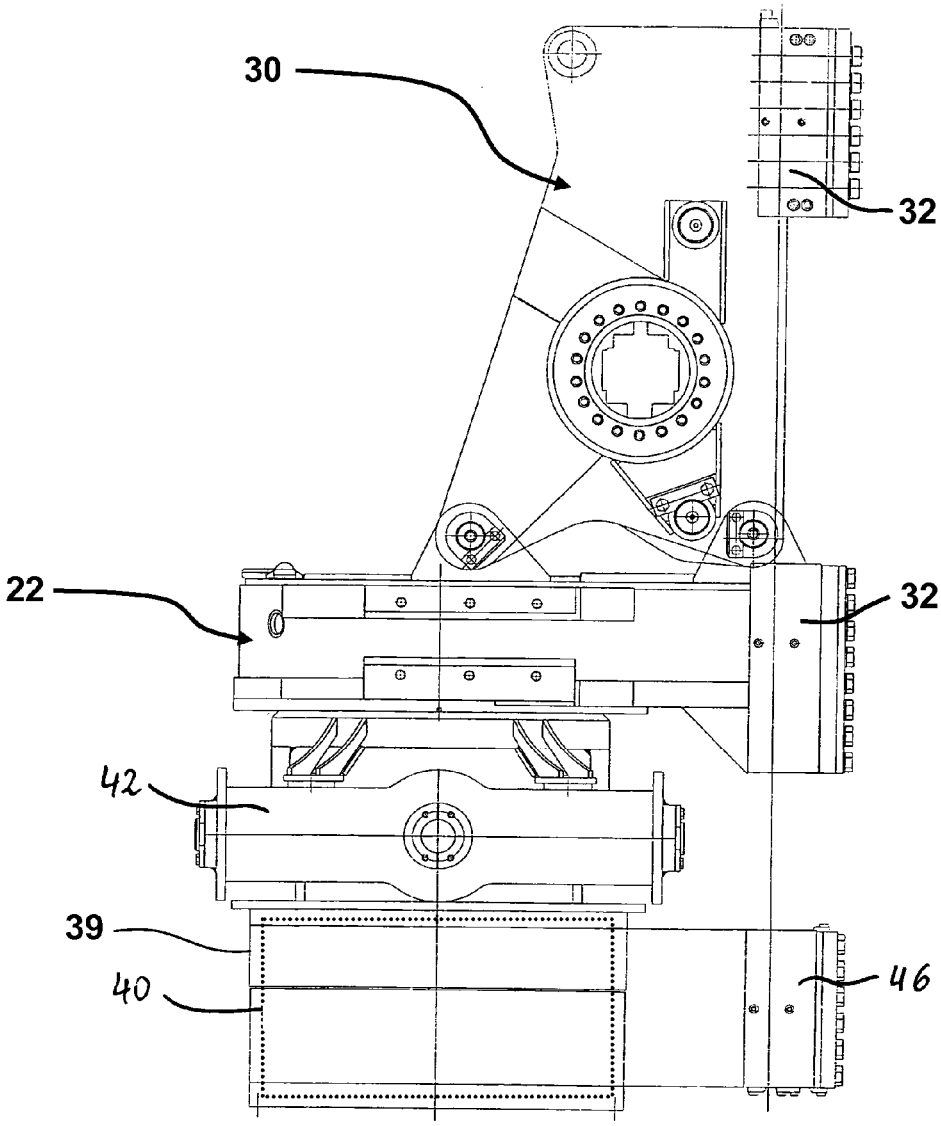
FIG. 4 An embodiment of a drill drive with gearing with a transmission to high speed and universal joint at the gearing input.

FIG. 4 shows a gearing 40 with a transmission to a high a speed, i.e. the gear 40 brings about a speed increase and a torque decrease. A first universal joint 42 is placed between gearing 40 and drill drive 22. The gearing 40 is placed on a second carriage 46 guided on mast 20. The second carriage 46 is guided along the same guide device 26 as the first carriage 30.

Figure 5:
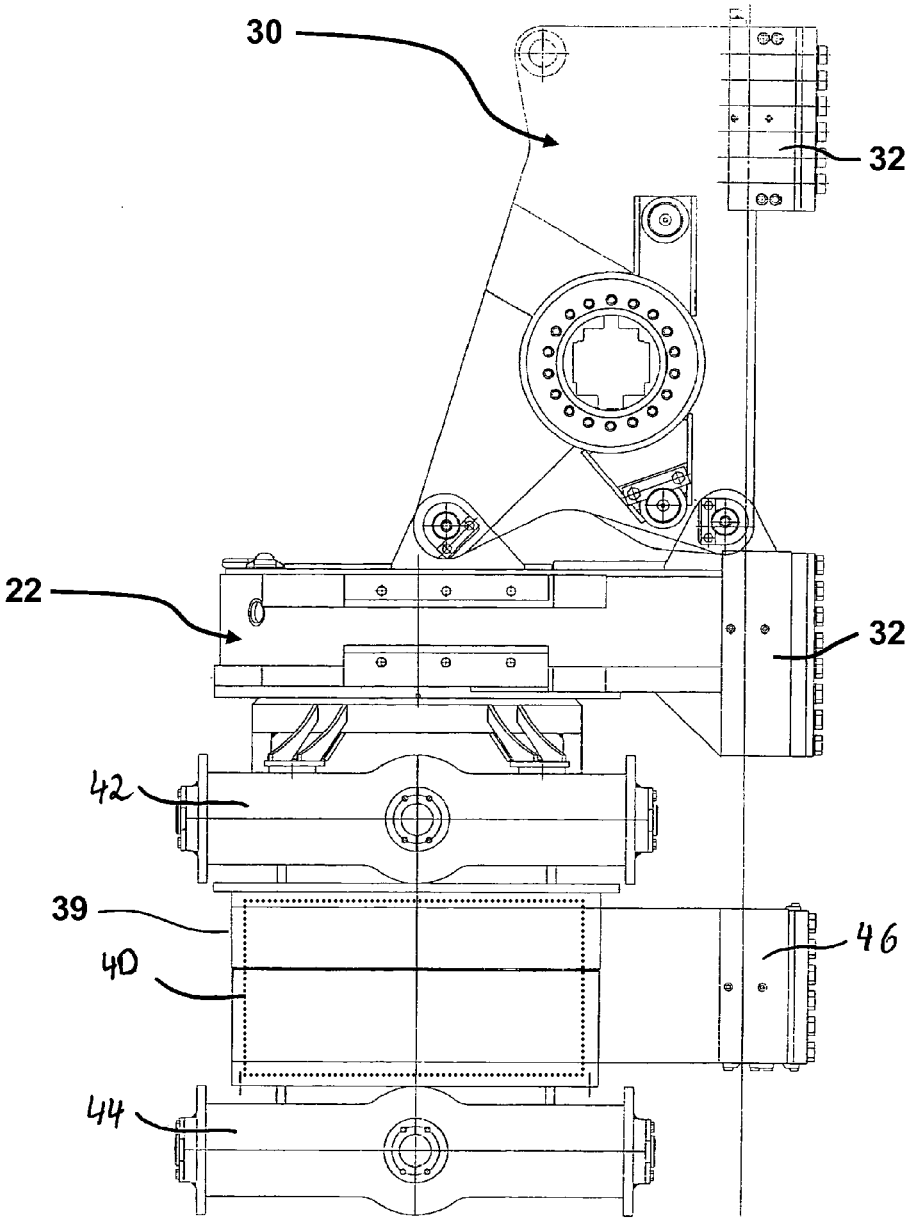
FIG. 5 The gearing shown in FIG. 4, additionally with a universal joint at the gear mechanism output.

FIG. 5 shows the arrangement of FIG. 4, additionally with a second universal joint 44 provided beneath gearing 40.

FIG. 6 shows a schematic illustration of the gearbox shown in FIG. 1, with the gearing, flange connections, drive unit (hollow shaft), driven unit (hollow shaft), and connecting devices, and their relationship to the drill drive and the drill rod.

The invention claimed is:

1. Drilling implement for driving a drill rod, the drilling implement having a mast, a drill drive guided on said mast for driving the drill rod, and a reversible gearing placed between the drill drive and the drill rod for transmission purposes, wherein the gearing has an input end and an output end, a drive unit with a first connecting device at the input end, and a driven unit with a second connecting device at the output end, the first connecting device and the second connecting device having a substantially identical construction, the first connecting device disengageably connecting the drive unit to the drill drive in a starting state of the gearing and disengageably connecting the drive unit to the drill rod in a reversed state of the gearing, and the second connecting device disengageably connecting the driven unit to the drill rod in the starting state of the gearing and disengageably connecting the driven unit to the drill drive in the reversed state of the gearing, whereby the gearing is placeable in disengageable, reversible manner on the drill drive, for inverting the gear ratio.

2. Drilling implement according to claim 1, wherein the gearing has an annular construction.

3. Drilling implement according to claim 2, wherein the gearing has an axis, and wherein the first and second connecting units, the drive unit, and the driven unit are aligned with the axis.

4. Drilling implement according to claim 1, wherein the gearing is mountable to the drill drive by a flange mount.

5. Drilling implement according to claim 4, wherein substantially identical flange mounts are provided at the gearing input and gearing output.

6. Drilling implement according to claim 1, further comprising:

a universal joint connecting the gearing to the drill drive.

7. Drilling implement according to claim 1, further comprising a first carriage guided on the mast, wherein the drill drive is placed on the first carriage.

8. Drilling implement according to claim 7, further comprising a second carriage guided on the mast, wherein the gearing is placed on the second carriage.

9. Drilling implement according to claim 1, further comprising:

at least one universal joint between the gearing and the drill rod.

10. Drilling implement according to claim 1, further comprising a carriage guided on the mast and a gearbox in which the gearing is received, wherein the gearbox has two substantially identically constructed flange connections at the input and output ends of the gearing for connecting the gearbox to the carriage so that the gearing is connectable to the drill drive in the starting state and in the reversed state of the gearing.

11. Drilling implement according to claim 10, wherein the gearbox has an axis, and wherein the flange connections are aligned with the axis.

* * * * *

UNITED STATES PATENT AND TRADEMARK OFFICE

CERTIFICATE OF CORRECTION

PATENT NO. : 8,002,048 B2
APPLICATION NO. : 12/230709
DATED : August 23, 2011
INVENTOR(S) : Matthias Saehn et al.

It is certified that error appears in the above-identified patent and that said Letters Patent is hereby corrected as shown below:

Title page, item (75), third named Inventor, change "Matthias Jais" to -- Melchior Jais --.

Signed and Sealed this
Eighteenth Day of November, 2014

Michelle K. Lee

Michelle K. Lee
*Deputy Director of the United States Patent and Trademark Office*